US009430969B2

(12) United States Patent
Shi

(10) Patent No.: US 9,430,969 B2
(45) Date of Patent: Aug. 30, 2016

(54) DRIVING CIRCUIT AND DRIVING METHOD FOR AMOLED PIXEL CIRCUIT

(71) Applicant: BOE Technology Group Co., Ltd., Beijing (CN)

(72) Inventor: Shiming Shi, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/549,772

(22) Filed: Nov. 21, 2014

(65) Prior Publication Data

US 2016/0117985 A1 Apr. 28, 2016

(30) Foreign Application Priority Data

Oct. 27, 2014 (CN) ..... 2014 1 0584117

(51) Int. Cl.
*G09G 3/32* (2016.01)

(52) U.S. Cl.
CPC .... *G09G 3/3258* (2013.01); *G09G 2300/0814* (2013.01); *G09G 2310/0281* (2013.01); *G09G 2310/0286* (2013.01)

(58) Field of Classification Search
CPC ..... G09G 3/3258; G09G 2300/0804; G09G 2300/0809; G09G 2300/0814; G09G 2310/0286; G09G 2310/0281; G09G 2310/0267; G09G 2310/0278; G09G 5/18
See application file for complete search history.

(56) References Cited

U.S. PATENT DOCUMENTS

2006/0279513 A1* 12/2006 Chung ..... G09G 3/20 345/100
2007/0124633 A1 5/2007 Kim
2009/0262051 A1* 10/2009 Kim ..... G09G 3/3266 345/80
2012/0044133 A1* 2/2012 Nakamizo ..... G11C 19/28 345/100
2012/0098826 A1* 4/2012 Lee ..... G09G 3/003 345/419
2013/0044854 A1* 2/2013 Yonemaru ..... G09G 3/3677 377/64

FOREIGN PATENT DOCUMENTS

CN 101685594 A 3/2010
CN 103913915 A 7/2014
CN 104036726 A 9/2014

OTHER PUBLICATIONS

May 4, 2016—(CN)—First Office Action Appn 201410584117.9 with English Tran.

* cited by examiner

*Primary Examiner* — Tom Sheng
(74) *Attorney, Agent, or Firm* — Banner & Witcoff, Ltd.

(57) ABSTRACT

A control unit, driving circuit for a display panel and a driving method thereof, a display panel and a display apparatus are disclosed. The control unit comprises a first module and a second module, and input terminals of the first module and the second module are connected with a first control voltage and the pulses. The first module converts the received pulses into a first group of pulses and outputs them under the control of a first group of control signal lines, and the second module converts the received pulses into a second group of pulses and outputs them under the control of a second group of control signal lines. The number of driving chips to be used can be reduced by one third.

19 Claims, 3 Drawing Sheets

DRIVING CIRCUIT AND DRIVING METHOD FOR AMOLED PIXEL CIRCUIT

This application claims priority to Chinese Patent Application No. 201410584117.9, filed on Oct. 27, 2014. The present application claims priority to and the benefit of the above-identified application and is incorporated herein in its entirety.

TECHNICAL FIELD OF THE DISCLOSURE

The present disclosure relates to a driving circuit for a pixel compensation circuit of an AMOLED and a method used for the driving circuit.

BACKGROUND

With rapid progress of display technologies, a display apparatus with touch function is becoming welcomed by more and more people due to its advantages such as visualized operation and so on. Existing display apparatuses with touch function can typically be classified into on-cell touch panels and in-cell touch panels in terms of different relative positions between the touch panel and the display panel. Compared with the on-cell touch panel, the in-cell panel is thinner and has higher light transmittance.

As for existing display apparatuses, the OLED (Organic Light Emitting Diode) as a current-type light emitting device is applied to the high performance display area more and more due to its advantages such as self luminescence, rapid response, wide angle of view, capability of being fabricated on a flexible substrate, and so on. OLED display apparatus can be classified into a PMOLED (Passive Matrix Driving OLED) type and an AMOLED (Active Matrix Driving OLED) type in terms of different driving manners. Since the AMOLED display has advantages such as low manufacturing cost, high response speed, low power consumption, capability of being used in direct current driving of portable devices, large range of operating temperature and so on, the AMOLED display potentially becomes a new flat display of next generation for replacing the LCD (Liquid Crystal Display). In existing AMOLED display panels, every OLED is driven to emit light by a pixel driving circuit consisting of multiple TFTs (Thin Film Transistors) within one pixel unit on the array substrate to realize display. The pixel driving circuit directly decides the quality of light emitting and displaying of the OLED; therefore, the design of the pixel driving circuit is a key technology of the AMOLED.

It is very hard to achieve consistency of the threshold voltages of TFTs in a large area due to the manufacturing technologies and the material characteristics of TFTs. In the AMOLED display panel, the OLEDs are current sensitive devices and are driven by TFTs to control the light emitting intensity; therefore, if the threshold voltages of the TFTs vary in the display area, the brightness uniformity of the whole picture will be influenced largely, which influences the picture quality.

SUMMARY

In order to reduce the number of chips to be used while enabling the 4T2C pixel compensation circuit to use conventional gate driving chips to reduce the development cost, the present disclosure provides a driving circuit for the 4T2C pixel compensation circuit and a method for the driving circuit, wherein it is possible for the 4T2C pixel compensation circuit to use conventional gate driving chips and to reduce the number of driving chips to be used by one third with a group of control units. When GOA (Gate driver On Array) driving is used, it is possible to reduce the number of GOA units by one third and raise the reliability.

According to one aspect of embodiments of the present disclosure, there is provided a control unit which receives pulses, the control unit comprises a first module and a second module, and input terminals of the first module and the second module are connected with a first control voltage and the pulses, wherein the first module converts the received pulses into a first group of pulses and outputs them under the control of a first group of control signal lines; and the second module converts the received pulses into a second group of pulses and outputs them under the control of a second group of control signal lines.

Optionally, the first module comprises a first control transistor and a second control transistor; the second module comprises a third control transistor and a fourth control transistor; the first group of control signal lines comprises a first control signal line and a second control signal line; and the second group of control signal lines comprises a third control signal line and a fourth control signal line; and wherein a control terminal of the first control transistor is connected to the first control signal line, a first terminal of the first control transistor is connected with the first control voltage, a second terminal of the first control transistor is connected to a second terminal of the second control transistor; a control terminal of the second control transistor is connected to the second control signal line, a first terminal of the second control transistor is connected with the received pulses; a control terminal of the third control transistor is connected to the third control signal line, a first terminal of the third control transistor is connected with the received pulses, a second terminal of the third control transistor is connected to a second terminal of the fourth control transistor; a control terminal of the fourth control transistor is connected to the fourth control single line, a first terminal of the fourth control transistor is connected with the first control voltage; and wherein the second terminals of the first control transistor and the second control transistor output the first group of pulses, and the second terminals of the third control transistor and the fourth control transistor output the second group of pulses.

According to another aspect of embodiments of the present disclosure, there is provided a driving circuit for a display panel, the driving circuit comprises gate drivers at two sides which output driving pulses in a manner of row-wise shifting, wherein the driving circuit further comprises a control section connected to output terminals of the gate driver at a first side; the control section comprises multiple control units each of which is a control unit as described in the above, and the received pulses are each row of pulses output by the gate driver at the first side.

Optionally, the gate driver at a second side outputs a third group of pulses.

Optionally, the gate drivers are gate drivers using GOA.

According to another aspect of embodiments of the present disclosure, there is provided a driving method for a driving circuit as described in the above, comprising, for each row of pixel circuits in a display panel, performing the following operations for each row of pulse output by the gate driver at the first side and the corresponding control unit of the control section:

before a reset phase, setting pulses output by the gate driver at the first side as the first control voltage, the first control signal line applying a fourth control voltage, the second control signal line applying a third control voltage, the third control signal line applying the third control voltage, and the fourth control signal line applying the fourth control voltage;

at the reset phase, a compensation phase and a data loading phase, setting pulses output by the gate driver at the first side as a second control voltage, the second control signal line applying the fourth control voltage and the first control signal line applying the third control voltage when the first group of pulses are needed to output the second control voltage, and the third control signal line applying the fourth control voltage and the fourth control signal line applying the third control voltage when the second group of pulses are needed to output the second control voltage; and at a light emitting phase, setting pulses output by the gate driver at the first side as the first control voltage, the first control signal line applying the fourth control voltage, the second control signal line applying the third control voltage, the third control signal line applying the third control voltage, and the fourth control signal line applying the fourth control voltage.

Optionally, the first control voltage is a voltage capable of turning off transistors in the pixel circuit, the second control voltage is a voltage capable of turning on transistors in the pixel circuit, the third control voltage is a voltage capable of turning off transistors in the control unit, and the fourth control voltage is a voltage capable of turning on transistors in the control unit.

Optionally, the driving method further comprises:

before the reset phase, setting pulses output by the gate driver at the first side as the first control voltage, the first control signal line applying the fourth control voltage, the second control signal line applying the third control voltage; the third control signal line applying the third control voltage, and the fourth control signal line applying the fourth control voltage;

at the reset phase, setting pulses output by the gate driver at the first side as the second control voltage, the third control signal line applying the fourth control voltage, and the fourth control signal line applying the third control voltage, at the first half of the reset phase, the first control signal line still applying the fourth control voltage and the second control signal line still applying the third control voltage, at the second half of the reset phase, the second control signal line applying the fourth control voltage and the first control signal line applying the third control voltage;

at the compensation phase and the data loading phase, setting pulses output by the gate driver at the first side as the second control voltage, the second control signal line applying the fourth control voltage, the first control signal line applying the third control voltage, the third control signal line applying the third control voltage, and the fourth control signal line applying the fourth control voltage; and at the light emitting phase, setting pulses output by the gate driver at the first side as the first control voltage, the first control signal line applying the fourth control voltage, the second control signal line applying the third control voltage, the third control signal line applying the third control voltage, and the fourth control signal line applying the fourth control voltage.

Optionally, the driving method further comprises:

before the reset phase and at the reset phase and the compensation phase, setting each row of pulses output by the gate driver at a second side as the second control voltage;

at the data loading phase, setting each row of pulses output by the gate driver at the second side as the first control voltage; and at the light emitting phase, setting each row of pulses output by the gate driver at the second side as the second control voltage.

According to another aspect of the present disclosure, there is provided a display panel comprising pixel circuits and a pixel driving circuit used to supply driving signals for the pixel circuits, wherein the pixel driving circuit is a driving circuit as described above.

According to another aspect of the present disclosure, there is provided a display apparatus comprising the display panel.

The driving circuit and the driving method provided by embodiments of the present disclosure enable the 4T2C pixel compensation circuit to use conventional gate driving chips and reduce the number of driving chips to be used by one third with a group of control units.

BRIEF DESCRIPTION OF THE DRAWINGS

In order to describe the solutions of embodiments of the present disclosure more clearly, the figures of the embodiments are introduced briefly in the following. Obviously, the figures described in the following are only part of embodiments of the present disclosure without limiting the present disclosure. In the figures, same reference numerals indicate same elements.

DETAILED DESCRIPTION

To the knowledge of the inventor, a 4T2C inside-pixel compensation circuit is used currently, that is, each pixel is driven by 4 TFTs and 2 capacitors, so that the working current flowing through the light emitting device is not influenced by the threshold voltage of the driving TFTs.

Figure 1:
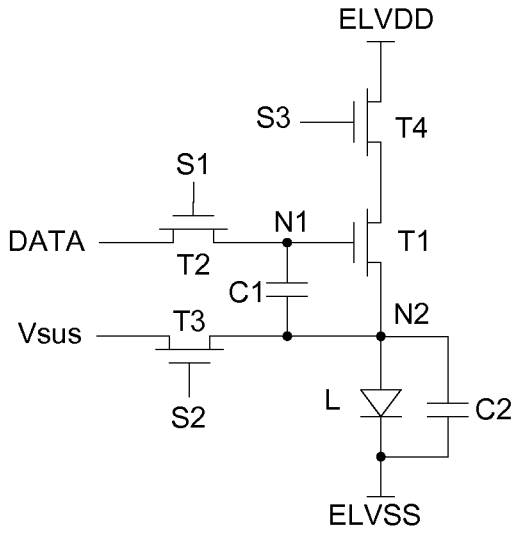
FIG. 1 is a circuit diagram of a conventional inside-pixel compensation circuit using 4T2C.
Figure 2:
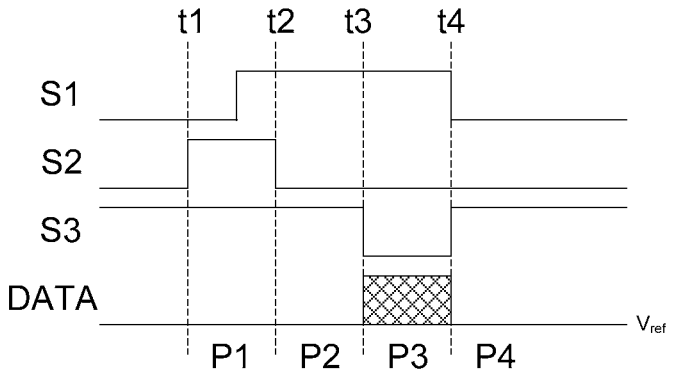
FIG. 2 is a time sequence diagram of key signals in a driving method of the 4T2C inside-pixel compensation circuit shown in FIG. 1.

FIG. 1 is a circuit diagram of a normal inside-pixel compensation circuit using 4T2C. FIG. 2 is a time sequence diagram of key signals in the driving method of the inside-pixel compensation circuit shown in FIG. 1.

As shown in FIG. 2, the operation of each row of pixel circuits is divided into 4 phases. P1 is a reset phase, P2 is a compensation phase, P3 is a data loading phase, and P4 is a light emitting phase. Through the operations of the 4 phases, the voltage difference between the gate and the source of the driving TFT T1 can be made to $Vgs=V_{N1}-V_{N2}$, which avoids the influence of the threshold voltage of T1 on the working current flowing through the light emitting device.

However, the above method typically needs a specially designed gate driving chip. Each row of pixels correspond to 3 gate driving lines, i.e., S1, S2 and S3 as shown in FIG. 1 and FIG. 2. Each row of pixels need the driving chip to output 3 signals. This means that the number of the output channels of a chip with the same size is reduced to one-third of its original number, and thus more chips are needed. If 1200 rows of pixels need to be driven, three conventional chips each of which has 1200 output channels are needed, and the layout design is difficult. A specially designed driving chip of 1200 channels with the same size can only support driving of 400 rows; therefore, if 1200 rows of pixels need to be driven, 3 such chips are needed too.

In the following, the technical solutions in embodiments of the present disclosure will be clearly and completely described in connection with the drawings. Obviously, the described embodiments are only part of the employments of the disclosure, but not all the employments. All other embodiments obtained by those skilled in the art based on the embodiments in the present disclosure without creative work fall into the protection scope of the present disclosure.

Figure 3:
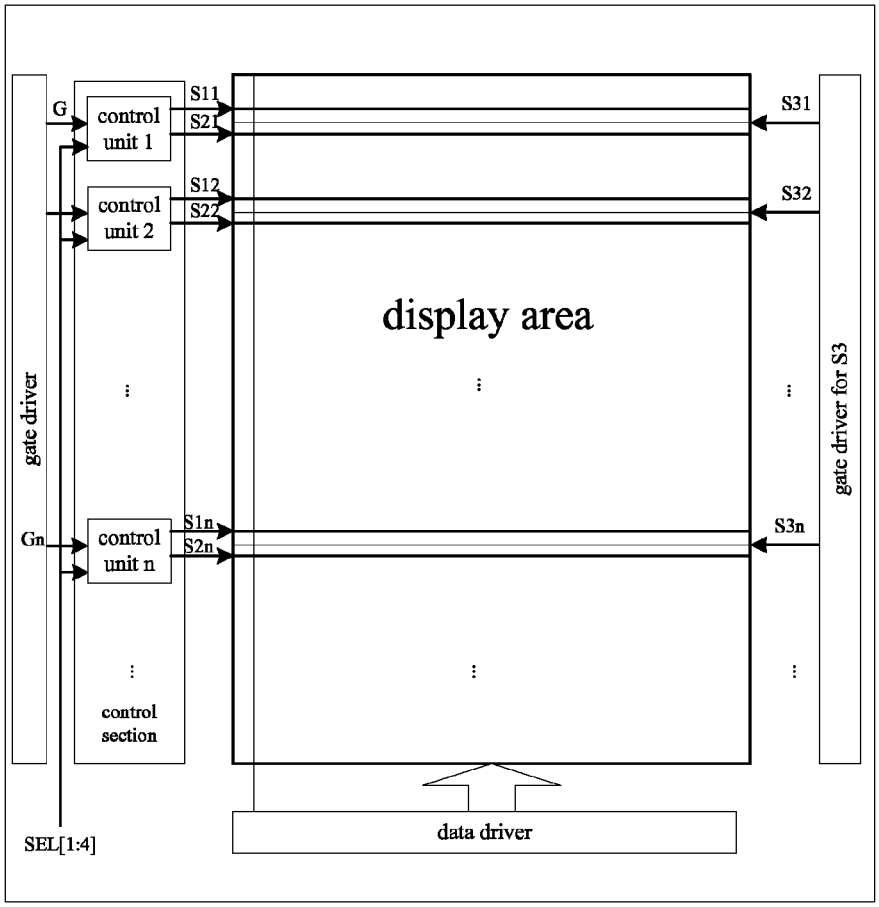
FIG. 3 is a structural block diagram of a driving circuit for a display panel consisting of the 4T2C inside-pixel compensation circuits shown in FIG. 1 provided by an embodiment of the present disclosure.

FIG. 3 is a structural block diagram of a driving circuit for a display panel consisting of the 4T2C inside-pixel compensation circuits shown in FIG. 1 provided by an embodiment of the present disclosure. The inside-pixel compensation circuit as shown in FIG. 1 comprises: a first transistor T1, a second transistor T2, a third transistor T3, a fourth transistor T4, a first capacitor C1, a second capacitor C2 and a light emitting device L.

The control terminal of the first transistor T1 is connected to a second terminal of the second transistor T2 and a first terminal N1 of the first capacitor C1, a first terminal of the first transistor T1 is connected to a second terminal of the fourth transistor T4, a second terminal of the first transistor T1 is connected to a first terminal of the light emitting device L, a second terminal N2 of the first capacitor C1 and a first terminal of the second capacitor C2. The control terminal of the second transistor T2 is connected with a first driving signal S1, and a first terminal of the second transistor T2 is connected to a data line DATA. The control terminal of the third transistor T3 is connected with a second driving signal S2, a first terminal of the third transistor T3 is connected with a second voltage Vsus, and a second terminal of the third transistor T3 is connected to the second terminal N2 of the first capacitor C1. The control terminal of the fourth transistor T4 is connected with a third driving signal S3, and a first terminal of the fourth transistor T4 is connected with a first voltage ELVDD. A second terminal of the second capacitor C2 is connected to a second terminal of the light emitting device L. The second terminal of the light emitting device L is connected with a third voltage ELVSS.

In the embodiments of the present disclosure, the light emitting device L can be various current-driven light emitting devices in known technological solutions including LED (Light Emitting Diode) or OLED. In embodiments of the present disclosure, description is made by taking the OLED as an example.

As shown in FIG. 3, the driving circuit provided by an embodiment of the present disclosure uses conventional gate driving chips at the left and right sides which outputs driving pulses in a manner of row-wise shifting. The gate driver at a second side outputs pulses S3*n* for driving the fourth transistor T4 in each row of inside-pixel compensation circuits. The control section is added to connect to the output terminals of the gate driver at a first side. The control section consists of multiple control units each of which converts each row of pulse Gn output by the gate driver at the first side into two groups of pulses S1*n* and S2*n* according to control signals SEL1-SEL4. The two groups of pulses S1*n* and S2*n* are used to drive the second transistors T2 and the third transistors T3 of each row of inside-pixel compensation circuits respectively.

Figure 4:
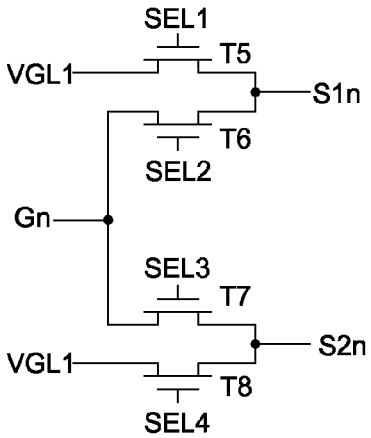
FIG. 4 is a circuit diagram of a control unit in the driving circuit provided by an embodiment of the present disclosure.

FIG. 4 is a circuit diagram of the control unit in the driving circuit provided by an embodiment of the present disclosure. As shown in FIG. 4, the control unit comprises four transistors T5-T8. A control terminal of the first control transistor T5 is connected to the first control signal line SEL1, a first terminal of the first control transistor T5 is connected with the first control voltage VGL1, a second terminal of the first control transistor T5 is connected to a second terminal of the second control transistor T6; a control terminal of the second control transistor T6 is connected to the second control signal line SEL2, a first terminal of the second control transistor T6 is connected with the pulse Gn output by the gate driver at the first side; a control terminal of the third control transistor T7 is connected to the third control signal line SEL3, a first terminal of the third control transistor T7 is connected with the pulse Gn output by the gate driver at the first side, a second terminal of the third control transistor T7 is connected to a second terminal of the fourth control transistor T8; a control terminal of the fourth control transistor T8 is connected to the fourth control single line SEL4, a first terminal of the fourth control transistor T8 is connected with the first control voltage VGL1; and the second terminals of the first control transistor T5 and the second control transistor T6 output the pulses S1*n* for driving the second transistors T2 of each row of inside-pixel compensation circuits, and the second terminals of the third control transistor T7 and the fourth control transistor T8 output the pulses S2*n* for driving the third transistors T3 of each row of inside-pixel compensation circuits.

Optionally, the above gate drivers are gate drivers using GOA.

Figure 5:
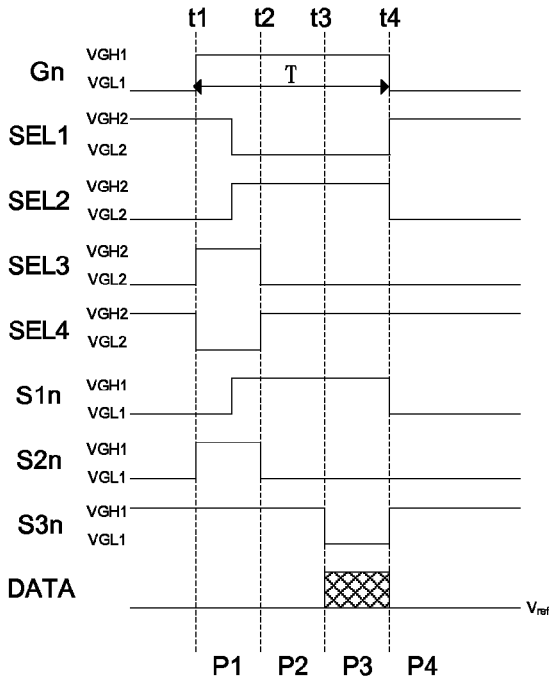
FIG. 5 is a time sequence diagram for key signals of the driving circuit shown in FIG. 3 provided by an embodiment of the present disclosure.

FIG. 5 is a time sequence diagram for key signals of the driving circuit shown in FIG. 3. The first control voltage VGL1 is a voltage capable of turning off TFTs in the inside-pixel compensation circuit shown in FIG. 1, the second control voltage VGH1 is a voltage capable of turning on TFTs in the inside-pixel compensation circuit, the third control voltage VGL2 is a voltage capable of turning off TFTs in the control unit shown in FIG. 4, and the fourth control voltage VGH2 is a voltage capable of turning on TFTs in the control unit. In the following, a driving method for the control unit shown in FIG. 4 according to an embodiment of the present disclosure will be described in connection with FIG. 4 and FIG. 5. The method comprises the following steps.

Before scanning to the $n^{th}$ row of pixels, that is, before the time t1 in FIG. 5 (before phase P1), pulse Gn output by the gate driver at the first side is set as the first control voltage VGL1, the first control signal line SEL1 applies a fourth control voltage VGH2, the second control signal line SEL2 applies a third control voltage VGL2, T1 is turned on, T2 is turned off, S1*n* outputs the first control voltage VGL1; the third control signal line SEL3 applies the third control voltage VGL2, the fourth control signal line SEL4 applies the fourth control voltage VGH2, T4 is turned on, T3 is turned off, and S2*n* outputs the first control voltage VGL1. As shown in FIG. 5, at this time, S1*n*-S2*n* before the time t1 correspond to S1-S2 before the time t1 in FIG. 2.

When scanning to the $n^{th}$ row of pixels, that is, at time t1-t4 in FIG. 5 (phases P1-P3), pulse Gn output by the gate driver at the first side is set as a second control voltage VGH1; when S1*n* is needed to output the second control voltage VGH1, the second control signal line SEL2 applies the fourth control voltage VGH2, the first control signal line SEL1 applies the third control voltage VGL2, T2 is turned on, and T1 is turned off; when S2*n* is needed to output the second control voltage VGH1, the third control signal line SEL3 applies the fourth control voltage VGH2, the fourth control signal line SEL4 applies the third control voltage VGL2, T3 is turned on, and T4 is turned off. As shown in FIG. 5, at this time, S1*n*-S2*n* between time t1 to t4 (i.e. phases P1-P3) correspond to S1-S2 between time t1 to t4 (i.e. phases P1-P3) in FIG. 2.

After the scanning of the $n^{th}$ row of pixels is finished, that is, after the time t4 in FIG. 5 (phase P4), pulse Gn output by the gate driver at the first side is set as the first control voltage VGL1, the first control signal line SEL1 applies the fourth control voltage VGH2, the second control signal line SEL2 applies the third control voltage VGL2, the third control signal line SEL3 applies the third control voltage VGL2, and the fourth control signal line SEL4 applies the fourth control voltage VGH2 to turn on T1 and T4 again and turn off T2 and T3. S1*n* and S2*n* output the first control voltage VGL1. As shown in FIG. 5, at this time, S1*n*-S2*n* after time t4 (i.e., phase P4) correspond to S1-S2 after time t4 (i.e., phase P4) in FIG. 2.

Optionally, the driving method for the control unit comprises:

before the reset phase P1, setting pulse Gn output by the gate driver at the first side as the first control voltage VGL1, the first control signal line SEL1 applying the fourth control voltage VGH2, the second control signal line SEL2 applying the third control voltage VGL2, T1 being turned on, T2 being turned off, S1*n* outputting the first control voltage VGL1; the third control signal line SEL3 applying the third control voltage VGL2, and the fourth control signal line SEL4 applying the fourth control voltage VGH2, T4 being turned on, T3 being turned off, S2*n* outputting the first control voltage VGL1;

at the reset phase P1, setting pulse Gn output by the gate driver at the first side as the second control voltage VGH1, the third control signal line SEL3 applying the fourth control voltage VGH2, and the fourth control signal line SEL4 applying the third control voltage VGL2, T3 being turned on, T4 being turned off, S2*n* outputting the second control voltage VGH1; at the first half of P1, the first control signal line SEL1 still applying the fourth control voltage VGH2, the second control signal line SEL2 still applying the third control voltage VGL2, T1 being turned on, T2 being turned off, and S1*n* outputting the first control voltage VGL1; at the second half of P1, the second control signal line SEL2 applying the fourth control voltage VGH2, the first control signal line SEL1 applying the third control voltage VGL2, T2 being turned on, T1 being turned off, and S1*n* outputting the second control voltage VGH1;

at the compensation phase P2 and the data loading phase P3, setting pulse Gn output by the gate driver at the first side as the second control voltage VGH1, the second control signal line SEL2 applying the fourth control voltage VGH2, the first control signal line SEL1 applying the third control voltage VGL2, T2 being turned on, T1 being turned off, and S1*n* outputting the second control voltage VGH1; the third control signal line SEL3 applying the third control voltage VGL2, and the fourth control signal line SEL4 applying the fourth control voltage VGH2, T4 being turned on, T3 being turned off, and S2*n* outputting the first control voltage VGL1; and at the light emitting phase P4, setting pulse Gn output by the gate driver at the first side as the first control voltage VGL1, the first control signal line SEL1 applying the fourth control voltage VGH2, the second control signal line SEL2 applying the third control voltage VGL2, T1 being turned on, T2 being turned off, and S1*n* outputting the first control voltage VGL1; the third control signal line SEL3 applying the third control voltage VGL2, and the fourth control signal line SEL4 applying the fourth control voltage VGH2, T4 being turned on, T3 being turned off, and S2*n* outputting the first control voltage VGL1.

An embodiment of the present disclosure also provides a driving method for the driving circuit shown in FIG. 3. In the following, the method will be described in connection with FIGS. 3-5. As shown in FIG. 5, for each row of pixels, the method comprises performing the above-described driving methods for the control unit for each row of pulse Gn output by the gate driver at the first side and the corresponding control unit of the control section, and setting each row of pulse S3*n* output by the gate driver at the second side as follows:

before the reset phase P1 and at the reset phase P1 and the compensation phase P2, setting each row of pulse S3*n* output by the gate driver at the second side as the second control voltage VGH1;

at the data loading phase P3, setting each row of pulse S3*n* output by the gate driver at the second side as the first control voltage VGL1; and at the light emitting phase P4, setting each row of pulse S3*n* output by the gate driver at the second side as the second control voltage VGH1.

S3*n* of each phase in FIG. 5 corresponds to S3 of respective phase in FIG. 2.

Figure 6:
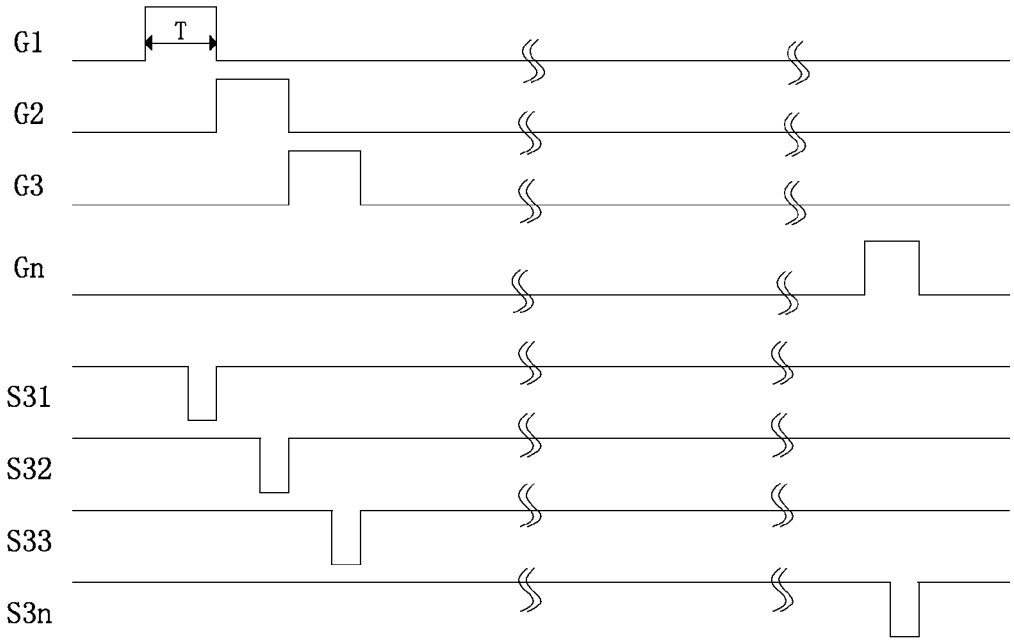
FIG. 6 is a schematic diagram for output signals output by the driving chip.

FIG. 6 is a schematic diagram of shift pulses output by the driving IC. Conventional gate driving chips can output such signals. The driving chip can be in COF (Chip on Film) package or COG (Chip on Glass) package.

Likewise, the control unit shown in FIG. 4 can be used in gate driving with GOA (Gate On Array), and it can realize driving for inside-pixel compensation circuits directly by normal GOA shift registers.

The present disclosure also provides a display panel comprising pixel circuits and a pixel driving circuit to supply driving signals for the pixel circuits, wherein the pixel driving circuit is a driving circuit as described above.

The present disclosure also provides a display apparatus comprising the above display panel.

The display apparatus herein can be electronic paper, a cell phone, a tablet, a TV set, a display, a notebook computer, a digital photo frame, a navigator, or any other product or devices with display function.

It can be noted that the above embodiments are only illustrative embodiments for illustrating the principle of the present disclosure, but the protection scope of the present disclosure is not limited to this. Those skilled in the art can devise various alternations or replacements which should be included within the protection scope of the present disclosure without departing from the spirit and essence of the present disclosure.

What is claimed is:

1. A control unit which is connected to an output terminal of a gate driver and receives driving pulses (Gn) from the gate driver, comprising a first module (T5, T6) and a second module (T7, T8), and input terminals of the first module (T5, T6) and the second module (T7, T8) are connected with a first control voltage (VGL1) and the pulses (Gn), respectively, wherein the first module (T5, T6) converts the received pulses (Gn) into a first group of pulses (Sin) and outputs them under control of a first group of control signal lines (SEL1, SEL2); and the second module (T7, T8) converts the received pulses (Gn) into a second group of pulses (S2*n*) and outputs them under control of a second group of control signal lines (SEL3, SEL4), the first module (T5, T6) comprises a first control transistor (T5) and a second control transistor (T6), the second module (T7, T8) comprises a third control transistor (T7) and a fourth control transistor (T8); the first group of control signal line (SEL1, SEL2) comprises a first control signal line (SEL1) and a second control signal line (SEL2); and the second group of control signal lines (SEL3, SEL4) comprises a third control signal line (SEL3) and a fourth control signal line (SEL4).

2. The control unit of claim 1, wherein a control terminal of the first control transistor (T5) is connected to the first control signal line (SEL1), a first terminal of the first control transistor (T5) is connected with the first control voltage (VGL1), a second terminal of the first control transistor (T5) is connected to a second terminal of the second control transistor (T6); a control terminal of the second control transistor (T6) is connected to the second control signal line (SEL2), a first terminal of the second control transistor (T6) is connected with the received pulses (Gn); a control terminal of the third control transistor (T7) is connected to the third control signal line (SEL3), a first terminal of the third control transistor (T7) is connected with the received pulses (Gn), a second terminal of the third control transistor (T7) is connected to a second terminal of the fourth control transistor (T8); a control terminal of the fourth control transistor (T8) is connected to the fourth control signal line (SEL4), a first terminal of the fourth control transistor (T8) is connected with the first control voltage (VGL1); and the second terminals of the first control transistor (T5) and the second control transistor (T6) output the first group of pulses (S1*n*), and the second terminals of the third control transistor (T7) and the fourth control transistor (T8) output the second group of pulses (S2*n*).

3. A driving circuit for a display panel, comprising gate drivers at two sides which output driving pulses in a manner of row-wise shifting, wherein the driving circuit further comprises a control section connected to output terminals of the gate driver at a first side and wherein the control section comprises multiple control units each of which is a control unit according to claim 2, and the received pulses (Gn) are each row of pulses (Gn) output by the gate driver at the first side.

4. The driving circuit of claim 3, wherein the gate driver at a second side outputs a third group of pulses (S3*n*).

5. The driving circuit of claim 4, wherein the gate drivers are gate drivers using GOA.

6. A driving method for a driving circuit according to claim 4, comprising, for each row of pixel circuits in a display panel, performing the following operations for each row of pulse (Gn) output by the gate driver at the first side and the corresponding control unit of the control section:

before a reset phase (P1), setting pulses (Gn) output by the gate driver at the first side as the first control voltage (VGL1), the first control signal line (SEL1) applying a fourth control voltage (VGH2), the second control signal line (SEL2) applying a third control voltage (VGL2), the third control signal line (SEL3) applying the third control voltage (VGL2), and the fourth control signal line (SEL4) applying the fourth control voltage (VGH2);

at the reset phase (P1), a compensation phase (P2) and a data loading phase (P3), setting pulses (Gn) output by the gate driver at the first side as a second control voltage (VGH1), the second control signal line (SEL2) applying the fourth control voltage (VGH2) and the first control signal line (SEL1) applying the third control voltage (VGL2) when the first group of pulses (S1*n*) are needed to output the second control voltage (VGH1), and the third control signal line (SEL3) applying the fourth control voltage (VGH2) and the fourth control signal line (SEL4) applying the third control voltage (VGL2) when the second group of pulses (S2*n*) are needed to output the second control voltage (VGH1); and at a light emitting phase (P4), setting pulses (Gn) output by the gate driver at the first side as the first control voltage, the first control signal line (SEL1) applying the fourth control voltage (VGH2), the second control signal line (SEL2) applying the third control voltage (VGL2), the third control signal line (SEL3) applying the third control voltage (VGL2), and the fourth control signal line (SEL4) applying the fourth control voltage (VGH2).

7. The driving circuit of claim 3, wherein the gate drivers are gate drivers using GOA.

8. A driving method for a driving circuit according to claim 3, comprising, for each row of pixel circuits in a display panel, performing the following operations for each row of pulse (Gn) output by the gate driver at the first side and the corresponding control unit of the control section:

before a reset phase (P1), setting pulses (Gn) output by the gate driver at the first side as the first control voltage (VGL1), the first control signal line (SEL1) applying a fourth control voltage (VGH2), the second control signal line (SEL2) applying a third control voltage (VGL2), the third control signal line (SEL3) applying the third control voltage (VGL2), and the fourth control signal line (SEL4) applying the fourth control voltage (VGH2);

at the reset phase (P1), a compensation phase (P2) and a data loading phase (P3), setting pulses (Gn) output by the gate driver at the first side as a second control voltage (VGH1), the second control signal line (SEL2) applying the fourth control voltage (VGH2) and the first control signal line (SEL1) applying the third control voltage (VGL2) when the first group of pulses (S1*n*) are needed to output the second control voltage (VGH1), and the third control signal line (SEL3) applying the fourth control voltage (VGH2) and the fourth control signal line (SEL4) applying the third control voltage (VGL2) when the second group of pulses (S2*n*) are needed to output the second control voltage (VGH1); and at a light emitting phase (P4), setting pulses (Gn) output by the gate driver at the first side as the first control voltage, the first control signal line (SEL1) applying the fourth control voltage (VGH2), the second control signal line (SEL2) applying the third control voltage (VGL2), the third control signal line (SEL3) applying the third control voltage (VGL2), and the fourth control signal line (SEL4) applying the fourth control voltage (VGH2).

9. A driving circuit for a display panel, comprising gate drivers at two sides which output driving pulses in a manner of row-wise shifting, wherein the driving circuit further comprises a control section connected to output terminals of the gate driver at a first side and wherein the control section comprises multiple control units each of which is a control unit according to claim 1, and the received pulses (Gn) are each row of pulses (Gn) output by the gate driver at the first side.

10. The driving circuit of claim 9, wherein the gate driver at a second side outputs a third group of pulses (S3*n*).

11. The driving circuit of claim 10, wherein the gate drivers are gate drivers using GOA.

12. A driving method for a driving circuit according to claim 10, comprising, for each row of pixel circuits in a display panel, performing the following operations for each row of pulse (Gn) output by the gate driver at the first side and the corresponding control unit of the control section:

before a reset phase (P1), setting pulses (Gn) output by the gate driver at the first side as the first control voltage (VGL1), the first control signal line (SEL1) applying a fourth control voltage (VGH2), the second control signal line (SEL2) applying a third control voltage (VGL2), the third control signal line (SEL3) applying the third control voltage (VGL2), and the fourth control signal line (SEL4) applying the fourth control voltage (VGH2);

at the reset phase (P1), a compensation phase (P2) and a data loading phase (P3), setting pulses (Gn) output by the gate driver at the first side as a second control voltage (VGH1), the second control signal line (SEL2) applying the fourth control voltage (VGH2) and the first control signal line (SEL1) applying the third control voltage (VGL2) when the first group of pulses (S1*n*) are needed to output the second control voltage (VGH1), and the third control signal line (SEL3) applying the fourth control voltage (VGH2) and the fourth control signal line (SEL4) applying the third control voltage (VGL2) when the second group of pulses (S2*n*) are needed to output the second control voltage (VGH1); and at a light emitting phase (P4), setting pulses (Gn) output by the gate driver at the first side as the first control voltage, the first control signal line (SEL1) applying the fourth control voltage (VGH2), the second control signal line (SEL2) applying the third control voltage (VGL2), the third control signal line (SEL3) applying the third control voltage (VGL2), and the fourth control signal line (SEL4) applying the fourth control voltage (VGH2).

13. The driving circuit of claim 9, wherein the gate drivers are gate drivers using GOA.

14. A driving method for a driving circuit according to claim 9, comprising, for each row of pixel circuits in a display panel, performing the following operations for each row of pulse (Gn) output by the gate driver at the first side and the corresponding control unit of the control section:

before a reset phase (P1), setting pulses (Gn) output by the gate driver at the first side as the first control voltage (VGL1), the first control signal line (SEL1) applying a fourth control voltage (VGH2), the second control signal line (SEL2) applying a third control voltage (VGL2), the third control signal line (SEL3) applying the third control voltage (VGL2), and the fourth control signal line (SEL4) applying the fourth control voltage (VGH2);

at the reset phase (P1), a compensation phase (P2) and a data loading phase (P3), setting pulses (Gn) output by the gate driver at the first side as a second control voltage (VGH1), the second control signal line (SEL2) applying the fourth control voltage (VGH2) and the first control signal line (SEL1) applying the third control voltage (VGL2) when the first group of pulses (S1*n*) are needed to output the second control voltage (VGH1), and the third control signal line (SEL3) applying the fourth control voltage (VGH2) and the fourth control signal line (SEL4) applying the third control voltage (VGL2) when the second group of pulses (S2*n*) are needed to output the second control voltage (VGH1); and at a light emitting phase (P4), setting pulses (Gn) output by the gate driver at the first side as the first control voltage, the first control signal line (SEL1) applying the fourth control voltage (VGH2), the second control signal line (SEL2) applying the third control voltage (VGL2), the third control signal line (SEL3) applying the third control voltage (VGL2), and the fourth control signal line (SEL4) applying the fourth control voltage (VGH2).

15. The driving method of claim 14, wherein the first control voltage (VGL1) is a voltage capable of turning off transistors in the pixel circuits, the second control voltage (VGH1) is a voltage capable of turning on transistors in the pixel circuits, the third control voltage is a voltage capable of turning off transistors in the control unit, and the fourth control voltage (VGH2) is a voltage capable of turning on transistors in the control unit.

16. The driving method of claim 15, further comprising:

before the reset phase (P1), setting pulses (Gn) output by the gate driver at the first side as the first control voltage (VGL1), the first control signal line (SEL1) applying the fourth control voltage (VGH2), the second control signal line (SEL2) applying the third control voltage (VGL2); the third control signal line (SEL3) applying the third control voltage (VGL2), and the fourth control signal line (SEL4) applying the fourth control voltage (VGH2);

at the reset phase (P1), setting pulses (Gn) output by the gate driver at the first side as the second control voltage (VGH1), the third control signal line (SEL3) applying the fourth control voltage (VGH2), and the fourth control signal line (SEL4) applying the third control voltage (VGL2), at the first half of the reset phase (P1), the first control signal line (SEL1) still applying the fourth control voltage (VGH2) and the second control signal line (SEL2) still applying the third control voltage (VGL2), at the second half of the reset phase (P1), the second control signal line (SEL2) applying the fourth control voltage (VGH2) and the first control signal line (SEL1) applying the third control voltage (VGL2);

at the compensation phase (P2) and the data loading phase (P3), setting pulses (Gn) output by the gate driver at the first side as the second control voltage (VGH1), the second control signal line (SEL2) applying the fourth control voltage (VGH2), the first control signal line (SEL1) applying the third control voltage (VGL2), the third control signal line (SEL3) applying the third control voltage (VGL2), and the fourth control signal line (SEL4) applying the fourth control voltage (VGH2); and at the light emitting phase (P4), setting pulses output (Gn) by the gate driver at the first side as the first control voltage (VGL1), the first control signal line (SEL1) applying the fourth control voltage (VGH2), the second control signal line (SEL2) applying the third control voltage (VGL2), the third control signal line (SEL3) applying the third control voltage (VGL2), and the fourth control signal line (SEL4) applying the fourth control voltage (VGH2).

17. The driving method of claim 14, further comprising:

before the reset phase (P1), setting pulses (Gn) output by the gate driver at the first side as the first control voltage (VGL1), the first control signal line (SEL1) applying the fourth control voltage (VGH2), the second control signal line (SEL2) applying the third control voltage (VGL2); the third control signal line (SEL3) applying the third control voltage (VGL2), and the fourth control signal line (SEL4) applying the fourth control voltage (VGH2);

at the reset phase (P1), setting pulses (Gn) output by the gate driver at the first side as the second control voltage (VGH1), the third control signal line (SEL3) applying the fourth control voltage (VGH2), and the fourth control signal line (SEL4) applying the third control voltage (VGL2), at the first half of the reset phase (P1), the first control signal line (SEL1) still applying the fourth control voltage (VGH2) and the second control signal line (SEL2) still applying the third control voltage (VGL2), at the second half of the reset phase (P1), the second control signal line (SEL2) applying the fourth control voltage (VGH2) and the first control signal line (SEL1) applying the third control voltage (VGL2);

at the compensation phase (P2) and the data loading phase (P3), setting pulses (Gn) output by the gate driver at the first side as the second control voltage (VGH1), the second control signal line (SEL2) applying the fourth control voltage (VGH2), the first control signal line (SEL1) applying the third control voltage (VGL2), the third control signal line (SEL3) applying the third control voltage (VGL2), and the fourth control signal line (SEL4) applying the fourth control voltage (VGH2); and at the light emitting phase (P4), setting pulses output (Gn) by the gate driver at the first side as the first control voltage (VGL1), the first control signal line (SEL1) applying the fourth control voltage (VGH2), the second control signal line (SEL2) applying the third control voltage (VGL2), the third control signal line (SEL3) applying the third control voltage (VGL2), and the fourth control signal line (SEL4) applying the fourth control voltage (VGH2).

18. The driving method of claim 14, further comprising:

before the reset phase (P1) and at the reset phase (P1) and the compensation phase (P2), setting each row of pulses (S3*n*) output by the gate driver at a second side as the second control voltage (VGH1);

at the data loading phase (P3), setting each row of pulses (S3*n*) output by the gate driver at the second side as the first control voltage (VGL1); and at the light emitting phase (P4), setting each row of pulses (S3*n*) output by the gate driver at the second side as the second control voltage (VGH1).

19. A display panel comprising pixel circuits and a pixel driving circuit to supply driving signals for the pixel circuits, wherein the pixel driving circuit is a driving circuit according to claim 9.

* * * * *